US011446674B2

(12) United States Patent
Hoogendoorn

(10) Patent No.: US 11,446,674 B2
(45) Date of Patent: Sep. 20, 2022

(54) BLOW BAR

(71) Applicant: KEESTRACK N.V., Munsterbilzen (BE)

(72) Inventor: Frederik Hoogendoorn, Munsterbilzen (BE)

(73) Assignee: Keestrack N.V., Munsterbilzen (BE)

( * ) Notice: Subject to any disclaimer, the term of this patent is extended or adjusted under 35 U.S.C. 154(b) by 103 days.

(21) Appl. No.: 16/759,215

(22) PCT Filed: Dec. 8, 2017

(86) PCT No.: PCT/EP2017/082015

§ 371 (c)(1),
(2) Date: Apr. 24, 2020

(87) PCT Pub. No.: WO2019/101351

PCT Pub. Date: May 31, 2019

(65) Prior Publication Data

US 2020/0306763 A1 Oct. 1, 2020

(30) Foreign Application Priority Data

Nov. 23, 2017 (DE) ..... 20 2017 107 107.3

(51) Int. Cl.
*B02C 13/28* (2006.01)

(52) U.S. Cl.
CPC ..... *B02C 13/2804* (2013.01)

(58) Field of Classification Search
CPC ..... B02C 13/06; B02C 13/2804; B02C 13/28
See application file for complete search history.

(56) References Cited

U.S. PATENT DOCUMENTS 2,588,434 A * 3/1952 Unti ..... B02C 13/2804 241/197
2,635,817 A * 4/1953 Long ..... B02C 13/2804 241/197

(Continued)

FOREIGN PATENT DOCUMENTS

DE 17831 11/1959
DE 2 307 988 9/1974

(Continued)

OTHER PUBLICATIONS

International Search Report issued by the European Patent Office in International Application PCT/EP2017/082015 dated Aug. 6, 2018.

*Primary Examiner* — Faye Francis
(74) *Attorney, Agent, or Firm* — Henry M. Feiereisen LLC

(57) ABSTRACT

A blow bar for inserting in a holder of a rotor of an impact crusher defines a longitudinal axis in a z-direction, a vertical axis in a y-direction, and a transverse axis in a x-direction. The blow bar includes two rectangular heads respectively arranged at upper and lower ends of the blow bar and defining there between a middle region, in which the longitudinal axis centrally determines a position of a y-z plane. Each head has side surfaces extending parallel to the y-z plane and parallel at a first spacing to define a thickness between the side surfaces. The two heads are situated offset to the y-z plane in opposite direction by a second spacing in the transverse direction, thereby forming support shoulders in a transition to the middle region. The middle region has a thickness which is not less than the first spacing of the side surfaces.

17 Claims, 7 Drawing Sheets

(56) References Cited

U.S. PATENT DOCUMENTS 2,747,803 A * 5/1956 Hanse ..... B02C 13/2804 241/191
3,236,463 A * 2/1966 Ratkowski ..... B02C 13/28 241/197
3,510,076 A * 5/1970 Perdue ..... B02C 13/28 241/197
3,608,841 A * 9/1971 Wageneder ..... B02C 13/095 241/189.1
3,838,826 A * 10/1974 Wallace ..... B02C 13/2804 241/197
3,929,296 A * 12/1975 Stoeber ..... B02C 13/2804 241/197
3,979,078 A * 9/1976 Boddeker ..... B02C 13/2804 241/191
4,180,213 A * 12/1979 Endo ..... B02C 13/2804 241/191
4,373,678 A * 2/1983 Reitter ..... B02C 13/2804 241/189.1
4,679,740 A * 7/1987 Orphall ..... B02C 13/2804 241/189.1
4,714,207 A * 12/1987 Schrodl ..... B02C 13/2804 241/189.1
4,848,682 A * 7/1989 Scheler ..... B02C 13/06 241/190
4,915,309 A * 4/1990 Schmidt ..... B02C 13/2804 241/191
5,111,569 A * 5/1992 Ostergaard ..... B02C 13/2804 29/407.05
6,845,933 B2 * 1/2005 Stemper ..... B02C 13/2804 241/189.1
2003/0127550 A1 * 7/2003 Stemper ..... B02C 13/2804 241/294

FOREIGN PATENT DOCUMENTS

DE 295 21 377 4/1997
DE 202017103587 8/2017
EP 0 787 529 8/1997

* cited by examiner

BLOW BAR

CROSS-REFERENCES TO RELATED APPLICATIONS

This application is the U.S. National Stage of International Application No. PCT/EP2017/082015, filed Dec. 8, 2017, which designated the United States and has been published as International Publication No. WO 2019/101351 A1 and which claims the priority of German Patent Application, Serial No. 20 2017 107 107.3, filed Dec. 23, 2017, pursuant to 35 U.S.C. 119(a)-(d).

BACKGROUND OF THE INVENTION

The invention relates to a blow bar for an impact crusher.

Impact crushers are used for the fragmentation of mineral materials (natural rock or recycling material) and for producing fine or coarse aggregate. In this process, the material in free fall is brought into the active zone of blow bars of a rotor and from here it is hurled against impact plates, where it is fragmented. The blow bars are wearing parts and need to be replaced regularly. Blow bars generally possess two beating zones, i.e., heads, which are used in succession when one of the heads has reached its wear limit. The blow bars can then be reversed about their own longitudinal axis. An as yet nonworn head of the blow bars, which was located in a blow bar holder in the rotor, then moves to the outside, so that the blow bar can be used until reaching the wear limit of this head as well. It is desirable in regard to the degree of utilization of the material employed for the middle region of the blow bars to be as small as possible and for the head subjected to the wear to be as large as possible. But if the middle region is too small, large stresses may occur in the blow bar. The blow bar may break, which may result in damage to other parts of the impact crusher. Repairs and production downtime are the consequence. If the middle region is too large, significant material portions of the blow bar might not be used for contact with the material being crushed. A lower degree of utilization is economically unfavorable. But if the middle region is too weak, a breakage of the blow bar may result in a premature total shutdown.

The problem which the invention proposes to solve is to indicate a blow bar for an impact crusher having a long service life and a high degree of utilization.

SUMMARY OF THE INVENTION

According to one aspect of the invention, a reversible blow bar is proposed for Inserting in an axially parallel blow bar holder of a rotor of an impact crusher. A maximum degree of utilization of the blow bar results if the blow bar can be turned over after one end of the blow bar becomes worn down. The blow bar has a middle region in its center and a respective beating zone adjacent to the middle region, also known as a head. One of the two heads at the ends of the beating side is located in a position of use, that is, it protrudes out from the rotor. The other head, meanwhile, is protected in a rotor holder of the rotor and can be brought into the position of use by turning the blow bar over.

The blow bar has a longitudinal axis running in the z-direction within a Cartesian coordinate system, which runs parallel to the blow bar holder of the rotor in the installation position. The blow bar has a vertical axis running in the y-direction, which is directed toward a radially outer top surface of the blow bar. Finally, the blow bar has a transverse axis running in the x-direction, which is directed toward a longitudinal side of the blow bar. The origin of this coordinate system is located at the center of the cross section area of the blow bar.

The blow bar is designed to be rotationally symmetrical with respect to its longitudinal axis. It does not have mirror symmetry with respect to the x-z plane or with respect to the y-z plane perpendicular thereto. The blow bar has a respective head with a rectangular cross section at its upper and lower ends in the vertical direction. Each head has side surfaces on the long side, running parallel to each other at a first spacing. This first spacing between the front and rear side surface defines the thickness of the respective rectangular head. Rectangular in this context means that the side surfaces run parallel to each other within the manufacturing tolerances and are also parallel to the y-z plane. Even so, the two heads are not arranged in mirror symmetry, but rather they are offset by a second spacing in opposite directions in the transverse direction, that is, the x-direction. The two heads are displaced relative to each other in the transverse direction, resulting not in a mirror symmetry, but rather a rotational symmetry with respect to the longitudinal axis. The blow bar is bent respectively at the transition to the central middle region. The middle region runs more or less diagonally between the two heads. There are support shoulders at the transition to the middle region on each longitudinal side of the blow bar, by which centrifugal forces of the blow bar can be channeled into the blow bar holder.

Advantageous modifications of the invention are set forth in the dependent claims.

One feature of the invention is that the middle region has a thickness over the majority portion of its length that is not less than the thickness of the heads. The "majority portion" refers to the overwhelming majority portion, that is, in particular more than 70% to 90%. For the axial pulling out of the blow bars from the blow bar holder, a support holder can be situated in the end region of the blow bars. A narrowing is located in this region, which reduces the cross section also in the middle region. However, this narrowing is insignificant for the degree of utilization and for the operating security of the blow bar. Apart from this somewhat thinner end region, the thickness of the middle region is not less than the thickness in the area of the heads. Furthermore, the middle region over its height looking in the vertical direction is not less than the thickness of the heads for the overwhelming majority portion of its height, especially its entire height. Statements about the thickness ratios always refer to the nonworn state of the blow bar.

In one modification of the invention, said middle region may be at least 3% thicker than the heads on the majority portion of its length. In the case of cast iron parts such as blow bars, one must expect manufacturing tolerances of +/−1%. The thickness differences between the middle region and the heads in this exemplary embodiment of the invention are significantly larger and preferably lie in a range of 2-5%, especially in a range of 3-4%. As a result, the blow bar according to the invention has a strengthened cross section and a greater resistance to fracture in this area.

A further advantageous exemplary embodiment of the invention calls for a contact surface which is formed on either side of the blow bar and is situated at the transition from the middle region to the rear side surface. By the contact surface, forces are transmitted from the blow bar in the radial direction into the rotor and the torque of the rotor is transmitted across a blow bar holder to the blow bar. The contact surface is raised. Thanks to the raised, i.e., projecting contact surface, additional material is present, making possible a surface machining of the contact surface, without producing a recess in the blow bar. The contact surface is also raised so that no constrictions result in this area. This avoids notch stresses. The contact surface is preferably only as wide and as long as needed. Therefore, it may also be shorter and narrower than the support shoulder. The contact surface itself runs parallel to the y-z plane.

The raised contact surface is adjoined by rounded flanks toward the rear side surface, the flanks being entirely concavely rounded. The advantage here is that the flanks always remain rounded regardless of material removed at the contact surface, so that the notch stresses arising under load in this area are kept to a minimum. The largest surface pressures between the rotor and the blow bar occur in the region of the contact surfaces, the two contact surfaces being subjected to continual wearing. It is therefore important that, even after a changing of a blow bar, the new blow bar has the most planar possible, i.e., flush surface in the area of the contact surfaces. The contact surfaces are therefore machined with chip removal.

In a first embodiment of the invention, the head terminates in the support shoulder adjoining the middle region. The support shoulder therefore extends beyond one rear side surface, but not beyond the other side surface on the corresponding longitudinal side of the blow bar. In an alternative embodiment of the invention, the support shoulder additionally extends beyond the front side surface. This support shoulder increases the contact area between the blow bar holder and the blow bar. The local surface pressure in regard to centrifugal forces is reduced.

In one modification of the invention, the obtuse angle by which the support shoulder is inclined relative to the side surfaces is additionally chosen to be smaller, especially smaller than 117°. Preferably, it amounts to 115°. A smaller angle has the advantage that the blow bar holder is subjected to lower spreading forces, which are a result of the centrifugal forces acting on the blow bar. The blow bar works like a wedge, widening the blow bar holder. A smaller angle reduces the wedge effect. A further benefit is that the design length of the middle region is reduced in this way. The material fraction of the middle region is less as compared to the heads. The degree of utilization is improved.

The configuration of the blow bars according to the invention is especially suitable for blow bars with a head thickness of 100 mm and an overall height of around 300 mm. Therefore, these are relatively compact and thick blow bars. The diametrically opposite front side surfaces are located at a spacing of around 30-40% of the head thickness. Hence, the decoupled blow bar has a total thickness of 130-140% of the thickness of a head. The raised contact surfaces are raised by around 8-15% relative to the thickness of the head, i.e., they project by around 10 mm at a head with a thickness of 100 mm. However, they do not increase the total thickness of the blow bar. The total thickness may however be increased beyond the above-indicated values if additional raised longitudinal webs are present. In this case, the longitudinal webs form the regions projecting most in the x-direction. They may have a respective thickness of 10-15% of the thickness of the heads and for example have a thickness of 13 mm for a head with a thickness of 100 mm, so that the blow bar has a total thickness of 148 mm. This corresponds roughly to proportions of 1:1.5 (total height: total thickness). Such a compact blow bar is extremely resistant to fracture in the middle region and at the same time it has a high degree of utilization.

BRIEF DESCRIPTION OF THE DRAWING

The Invention shall be explained more closely in the following with the aid of exemplary embodiments presented schematically in the figures. There are shown.

DETAILED DESCRIPTION OF PREFERRED EMBODIMENTS

Figure 1:
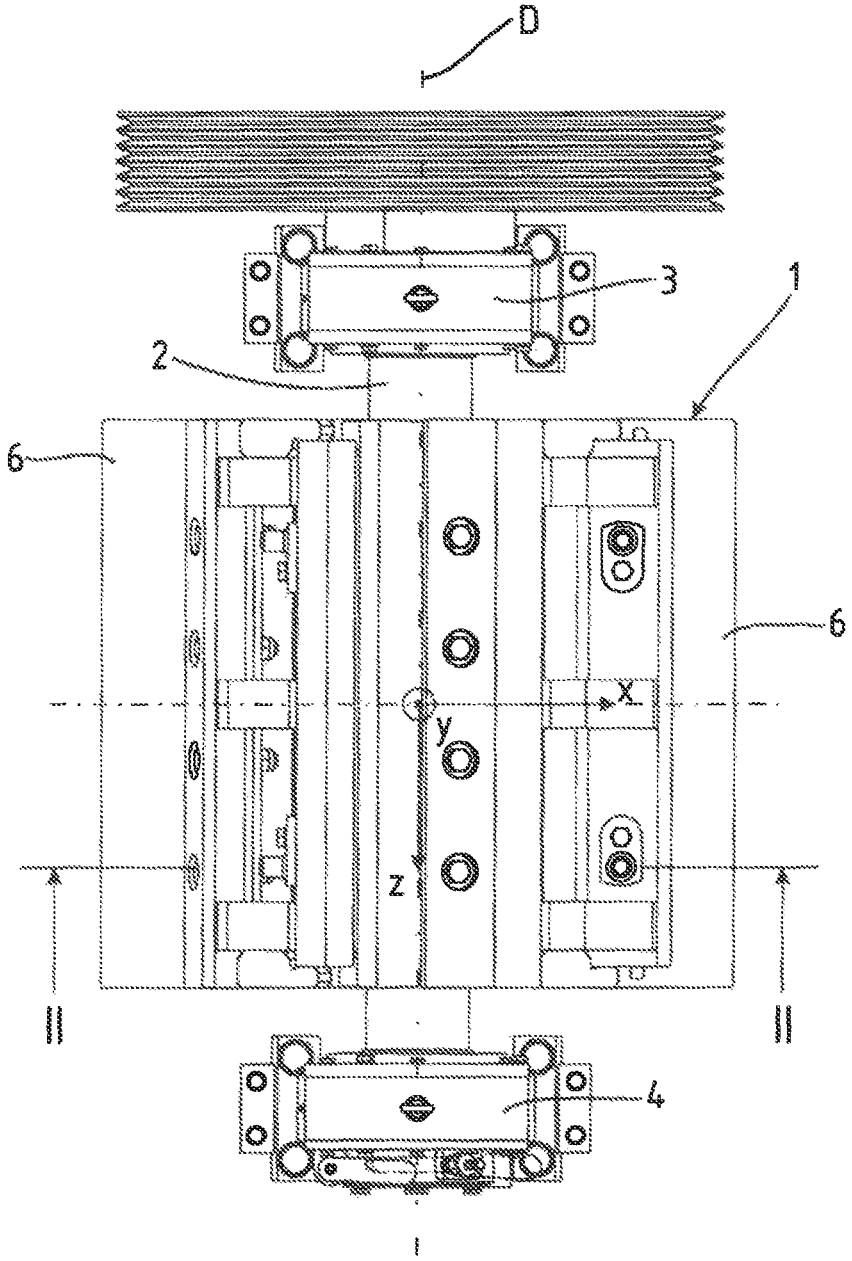
FIG. 1 a rotor of an impact crusher in a top view.

FIG. 1 shows a rotor 1 of an impact crusher not otherwise depicted. The rotor 1 has a horizontal rotor shaft 2, which is mounted in bearings 3, 4. The rotor shaft 2 extends horizontally between the bearings 3, 4. It is driven by a belt pulley 5. Mounted on the rotor 1 are four blow bars 6 distributed about the circumference. The blow bars 6 run parallel to the axis of rotation D of the rotor shaft 2.

Figure 2:
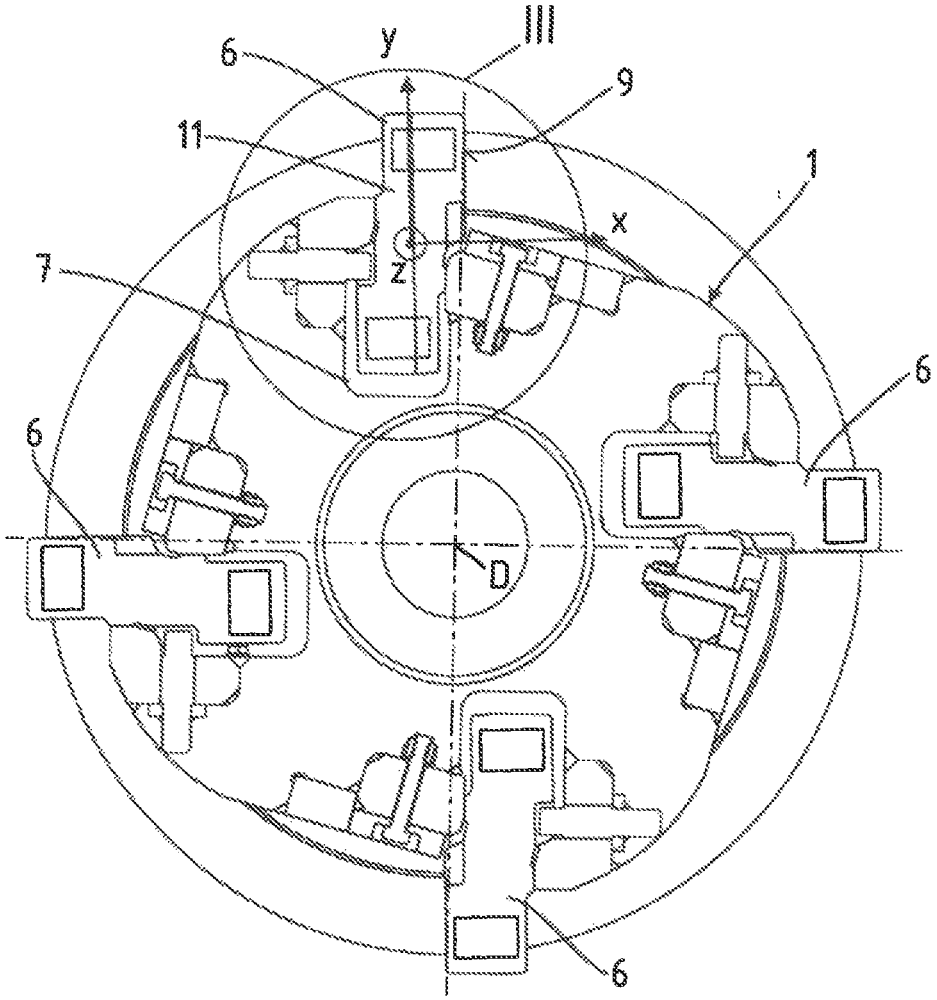
FIG. 2 a section through the rotor of FIG. 1 along line II-II.
Figure 3:
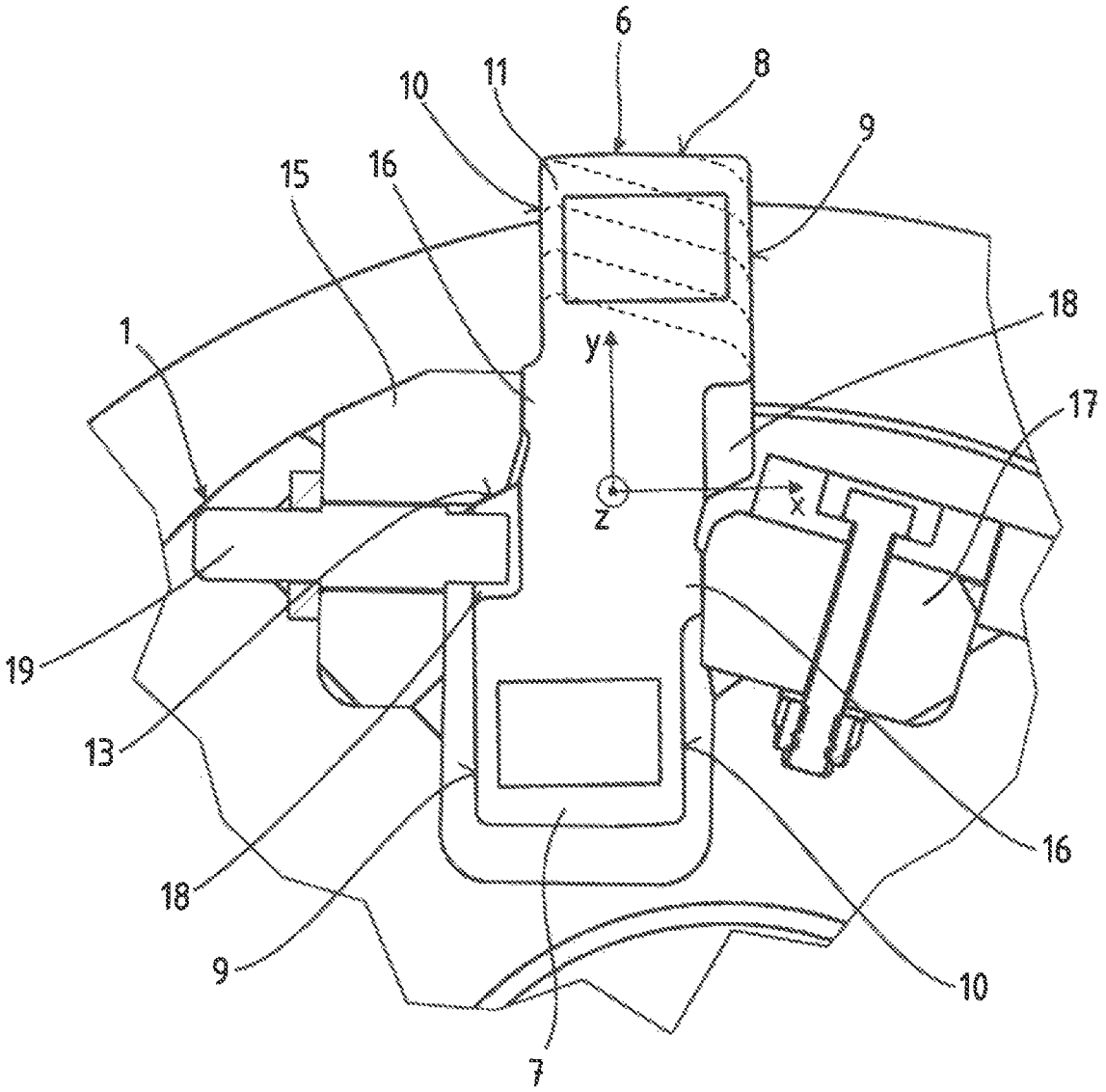
FIG. 3 feature III of FIG. 2.

In the following explanation of the blow bars 6, reference shall be made to a Cartesian coordinate system (FIGS. 1 to 4). The origin of the coordinate system is located at the center of the blow bar 6, i.e., at half length (z-axis), height (y-axis) and width (thickness) (x-axis) of said blow bar 6. The coordinate system pertains to the respective blow bar 6 and not to the rotor 1. Since the blow bar 6 is slightly inclined in the installation position, the coordinate system in FIGS. 2 and 3 is also slightly inclined about the longitudinal axis (z-axis) of the blow bar 6.

The x-direction of the coordinate system points in the direction of a surface normal to the front side surface 9. The y-axis is the radial direction and points away from the rotor shaft 2. The z-axis runs parallel to the front side surface 9 and to the axis of rotation D.

FIG. 2 shows that a total of four blow bars 6 are distributed evenly about the circumference of the rotor 1. The four blow bars 6 are identical. The blow bar holders 7 are recesses running in the longitudinal direction of the rotor 1, i.e., parallel to the axis of rotation D of the rotor shaft 2. In regard to the aforementioned coordinate system, the recesses run in the z-direction.

Figure 4:
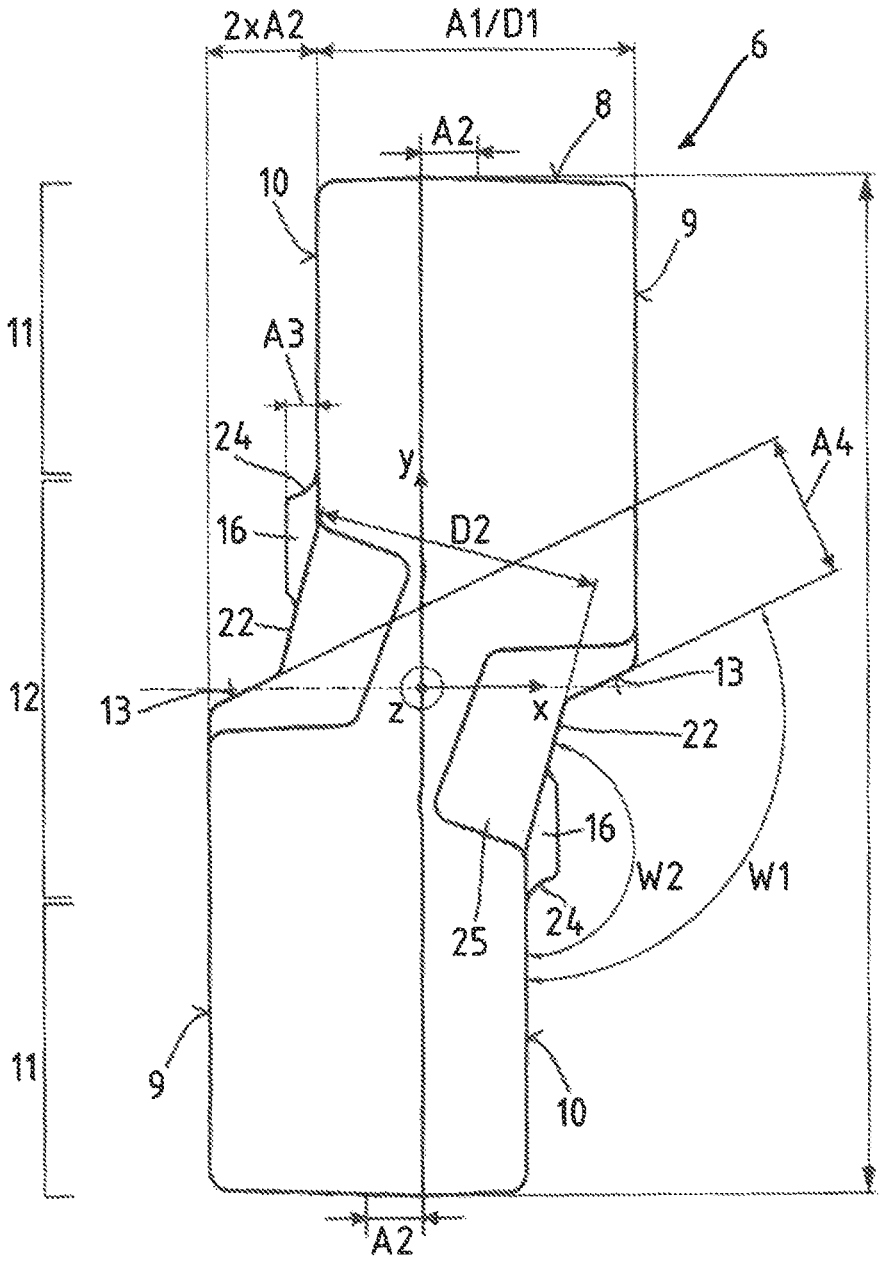
FIG. 4 the blow bar of FIG. 3 in a first view.

FIGS. 2 to 4 show that the blow bars 6 do not have mirror symmetry either in regard to the horizontal plane, i.e., the x-z plane, or the vertical longitudinal plane, i.e., the y-z plane. However, they have rotational symmetry with regard to the central longitudinal axis, which runs in the z-direction, because they can be projected onto themselves by a rotation of 180° about the longitudinal axis.

The blow bars 6 have respective radially outer top surfaces 8 (FIGS. 3 and 4) at their opposite ends. Since blow bars 6 are cast iron components, the top surfaces may have a slight mold slant due to the casting technology. The side surfaces 9, 10 of the blow bars 6 run in parallel spacing to each other and are therefore substantially perpendicular to the top surfaces 8 (FIG. 3). The blow bar 6 has a respective head 11 with a rectangular cross section at its upper and lower ends in the vertical direction, each head 11 having said front and rear side surfaces 9, 10, which run parallel to each other at a first spacing A1. The spacing A1 of the side surfaces 9, 10 is at the same time the thickness D1 of the head 11 in the x-direction (FIG. 3). Each head 11 has a constant thickness D1 over its entire length and height, so that the cross section of the head 11 is rectangular. The front side surface 9 serves as a beating surface, which is subjected to continual wearing during operation.

The blow bar 6 possesses a middle region 12 between the two heads 11, in which the longitudinal axis (z-axis) runs centrally. The side surfaces 9, 10 run parallel to the y-z plane, wherein the heads 11 are situated offset to the y-z plane in the opposite direction by a second spacing A2 in the transverse direction (x-direction). This means that, looking in the vertical direction, the upper head 11 is not entirely flush above the lower head 11. The two heads 11 are offset from each other in the transverse direction, while the middle region 12, joining the two heads 11 together, runs at a slant. The blow bar 6 is therefore bent on the whole. The second spacing A2 amounts to 10 to 20%, especially 15-20% of the thickness D1 of the head 11.

One feature of the invention is that the middle region 12 over the majority portion of its length has a thickness D2 which is at least not smaller than the thickness D1 of the heads 11. While the thickness D1 of the head 11 is measured in the x-direction, the thickness D2 of the middle region 12 refers to a direction of measurement running perpendicular to the slanted middle region 12. The thickness D2 of the middle region, even given the deviating direction of measurement, is not less than the thickness D1. The cross section in the central middle region 12 is not weakened and has no constrictions reducing its own thickness D2 compared to the thickness D1 of the heads 11. In this exemplary embodiment, the thickness D2 in the middle region is just as large as the thickness D2 of the head. The resistance to fracture in this central middle region 12 is significantly increased.

The blow bar 6 has a support shoulder 13 projecting in the x-direction relative to the front side surface 9 between the middle region 12 and the respective front side surfaces 9 of the heads 12 during operation. The greater the sideways offset of the heads 11, the further the support shoulder 13 is projecting.

The support shoulder passes into the front side surface 9. FIG. 3 shows how the support shoulder 13 in the installation position serves to hold the blow bar 6 in the blow bar holder 7. The support shoulder 13 is braced against a rear blow bar holder 15, which is welded in the rotor 1.

FIG. 3 shows by broken line the wear lines of the upper head 11. The wear process starts at the corner between the front side surface 9 in the transition to the top surface 8. Once the wear has proceeded too far, the blow bar 6 is turned over. The sectional representation of FIG. 3 furthermore shows that rectangular regions are situated within the heads 11 that are made of a more wear-resistant material than the surrounding shell of the blow bar 6. These may be an embedding of a ceramic material.

In the spacing of the support shoulder 13, a contact surface 16 (FIGS. 3 and 4) is located in the transition to the other head 11 of the blow bar 6. By the contact surface 16, the force acting in the circumferential direction is transmitted from the rotor 1 to the blow bar 6 or in the case of an impacting against material being crushed the force of impact is transmitted from the material to the rotor 1. In order to avoid stresses, it is advantageous to have a flush contact, i.e., the most complete contact possible, between the contact surface 16 and the blow bar holder 15. Since the blow bars 6 are cast iron parts, thermally caused warpage (hardening distortion) may occur during the fabrication process. A material-removing after-machining is required in order to create a planar surface. The material-removing after-machining unavoidably results in a reduction of the cross section of the blow bar, which is undesirable according to the invention, inasmuch as this forms constrictions. Therefore, the contact surface 16 is raised above the rear side surface 10 of the head 11 to such an extent that enough material is always available for the material-removing machining, without forming a constriction. In this exemplary embodiment, the contact surface 16 projects by the dimension A3, which corresponds to 10% of the thickness D1 of the head 11.

The diametrically opposite second contact surface 16 serves for bracing against a front blow bar holder 17. In operation, a large torque about the longitudinal axis is exerted by impacting material on the blow bar 6. The abutment surfaces on the blow bar holders 15, 17 which belong to the contact surfaces 16 run parallel to the side surfaces 9, 10 of the blow bar 6, within the manufacturing tolerances, so only normal forces are transmitted by the contact surfaces 16. Centrifugal forces are transmitted by the separate support shoulder. This functional separation is favorable for the force transmission and avoids stress peaks caused by superpositioning of normal forces and bending torques within the blow bar 6.

Figure 5:
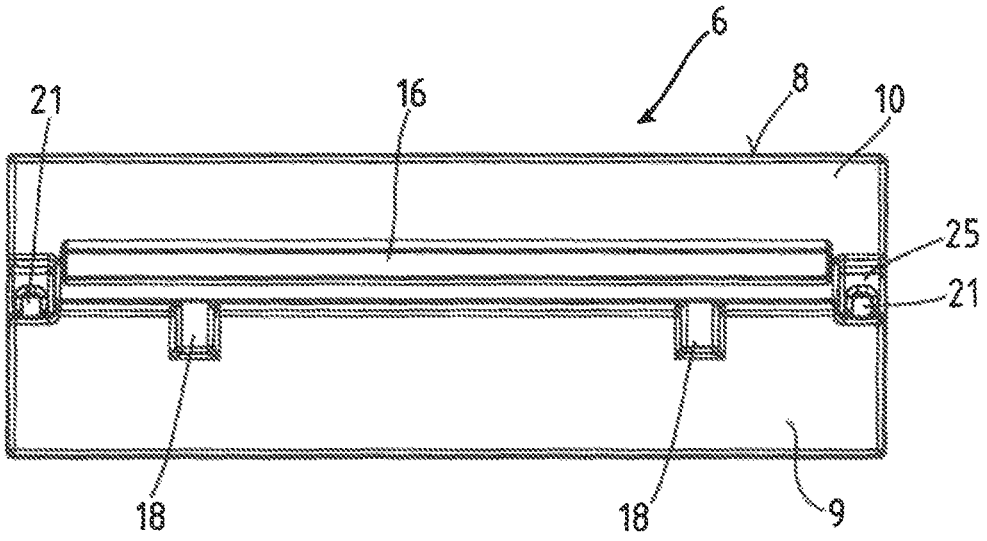
FIG. 5 the blow bar of FIG. 4 in a second view.
Figure 6:
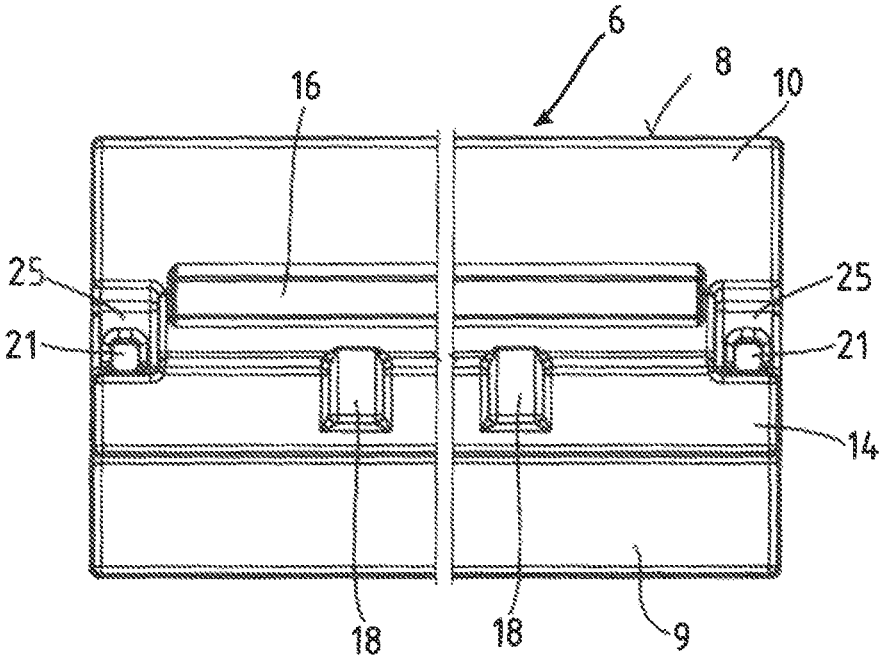
FIG. 6 a second embodiment of a blow bar in a view looking at the longitudinal side.
Figure 7:
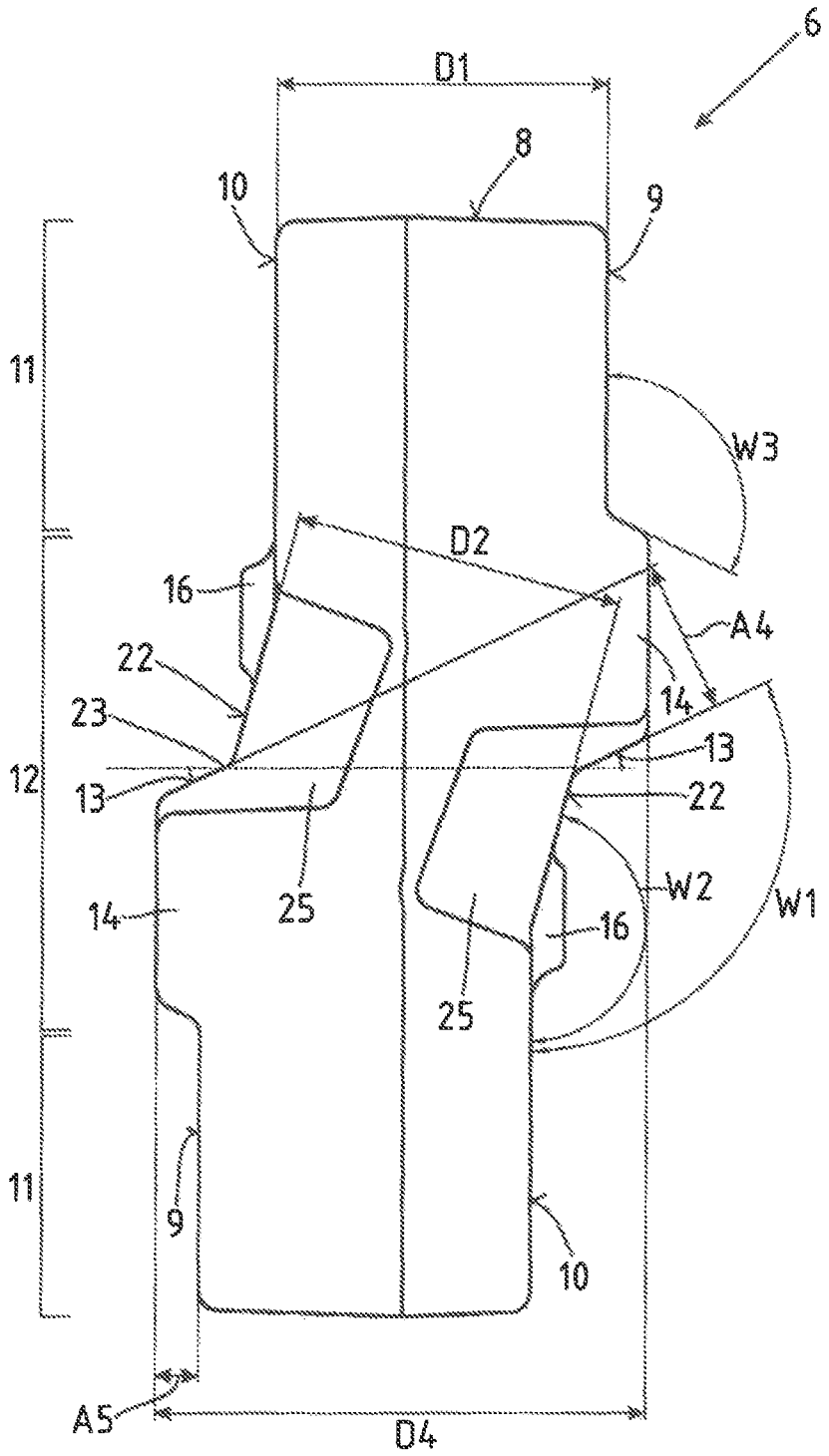
FIG. 7 the blow bar of FIG. 6 in a second view.
Figure 8:
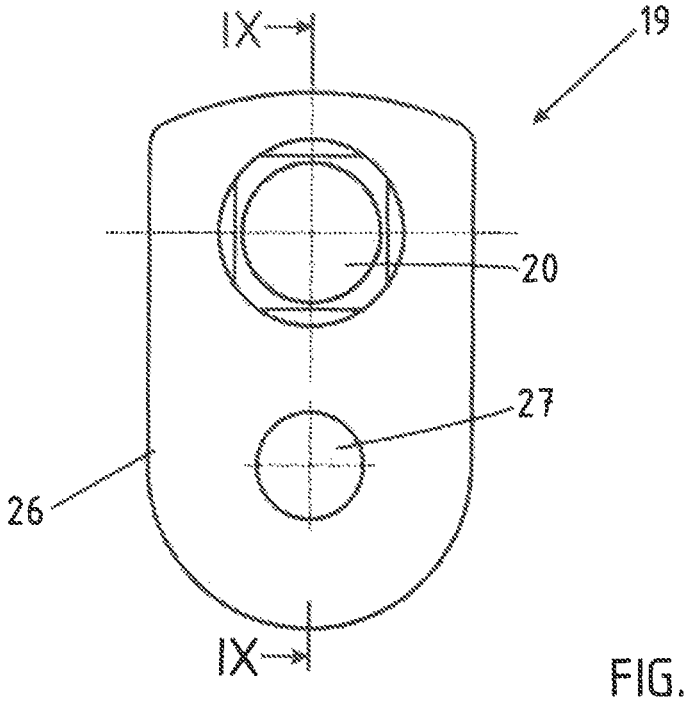
FIG. 8 an axial securing in a first view.
Figure 9:
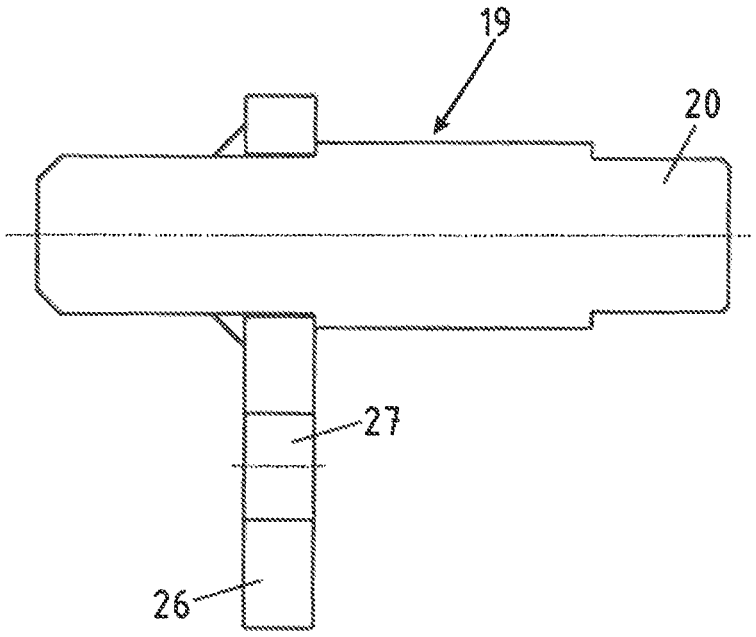
FIG. 9 the axial securing of FIG. 8 in longitudinal section along line IX-IX.

The blow bar holders 15, 17 guide and hold the blow bar 6 in the longitudinal direction and in the circumferential direction. A securing against axial displacement in the longitudinal direction of the rotor 1 is provided by at least one recess 18 adjacent to the support shoulder 13 (FIG. 3). The recesses 18 are adapted to hold a releasably insertable axial securing 19 (FIGS. 5 to 7). This axial securing 19 may be a securing pin, for example, which passes through a borehole in the blow bar holder 15 and engages in the recess 18. For fixation of the position, the at least one axial securing 19 can be screwed together with the blow bar holder 15. For this, the axial securing 19 has a plate 26 welded onto a bolt 20 and having a borehole 27 for a screw, as shown in FIGS. 8 and 9.

In theory, it is possible for only a single recess 18 to be present for each longitudinal side. But for reasons of safety, it is better to have two recesses 18 and axial securings 19 present, as is also shown in the side view of FIG. 5. The benefit of multiple axial securings as compared to a single axial securing is that in event of breakage of the blow bar the broken part will also be held with greater probability than in the case of only one axial securing, when the broken part necessarily cannot be held.

In the invention, neither does any weakening of the middle region 12 occur in the area of the recesses, because the contact surface 16 is situated opposite the recess 18 on the other side of the blow bar 6. In this area, the thickness of the blow bar 6 is greatest, as measured in the x-direction. According to the invention, neither is it smaller in this area than the thickness D1 of the heads 11, even deducting the depth of the recesses 18.

While the contact surfaces 16 are raised as compared to the rear side surfaces 10, this is not absolutely required for the support shoulders 13. The support shoulder 13 should above all absorb the centrifugal forces acting during the rotational movement on the blow bar 6. Therefore, the support shoulder 13 can directly adjoin a front side surface 9.

The support shoulder 13 according to a second exemplary embodiment may additionally project beyond the front side surface 9. In this case, longitudinal webs 14 are arranged on the front side surfaces 9. FIGS. 5 and 6 show the differences between a blow bar 6 with and without the longitudinal webs 14. The blow bar 6 of FIG. 6 is also represented in FIG. 7, using for FIG. 7 the same reference numbers as for FIG. 5.

The difference is merely the raised longitudinal web 14 on the support shoulder 13. Otherwise, for FIG. 7, refer to the explanations for FIG. 4.

FIGS. 5 and 6 moreover show that openings 21 in end-side recesses 25 are arranged adjacent to the contact surface 16 at the ends of the blow bar 6. The openings 21 and recesses 25 serve for holding an installing tool in order to install and remove the very heavy blow bars 6 in the blow bar holder 7.

The middle region 12 of the blow bars 6, functionally considered, is that region which is not worn down due to contact with the material being crushed. The middle region 12 includes the functional surfaces by which the blow bar 6 is held. The middle region 12 terminates at the height of the outer flanks 24 of the contact surfaces 16. At the opposite side, the middle region 12 terminates with the end of the recesses 18 or, if present, with the outer flanks of the longitudinal webs 14 (FIG. 4, FIG. 7).

The middle region 12 has slanted surfaces 22 on both sides, which run parallel to each other. They run at an angle W2 to the y-z plane which is different from 90°. The angle W2 is determined by the offset of the two heads 11 in the transverse direction and the mutual spacing of the heads 11 in the vertical direction. It is less than 180°. In this exemplary embodiment, it amounts to 165° (FIG. 4).

A flank angle W1 of the support shoulder 13 amounts to 115° in relation to the rear side surface 10. With respect to the front side surface 9, the flank angle W3 in this example likewise amounts to 115°. The slanted surfaces 22 in this exemplary embodiment therefore include an angle of 130° with the support shoulder 13. The steep angle W1 of the support shoulders 13 means that the support shoulders 13 are only situated at a slight parallel spacing A4 from each other. The support shoulders are situated near the middle of the blow bar 6. Therefore, the forces are introduced relatively centrally into the strengthened middle region 12. The stress paths are short. The material loading is less.

Between the slanted surface 22 and the support shoulder 13 there is a rounded transition 23. The rounding of the transition 23 avoids stress peaks. The rounding is less than that for the flanks 24 of the contact surface 16. The transition 23 lies in particular at the height of the x-axis.

The contact surfaces 16 are trapezoidal in cross section. Their flanks 24 are rounded with especially large radii, so that there are as few stress peaks as possible in the transition to the heads 11. The concavely rounded flanks 24 furthermore have the advantage that, regardless of how much material needs to be removed from the contact surfaces, a rounded transition to the side surfaces 10 and the slanted surfaces 22 always remains.

The exemplary embodiment of FIG. 7 shows that the longitudinal web 14 is trapezoidal overall, the flanks 24 of the longitudinal web 14 having the same flank angle as the support shoulder 13 bordering on the longitudinal web 14. Moreover, FIG. 7 shows the total thickness D4 of the blow bar 6.

REFERENCE SIGNS

1 Rotor
2 Rotor shaft
3 Bearing
4 Bearing
5 Belt pulley
6 Blow bar
7 Blow bar holder
8 Top surface
9 Side surface
10 Side surface
11 Head
12 Middle region
13 Support shoulder
14 Longitudinal web
15 Rear blow bar holder
16 Contact surface
17 Front blow bar holder
18 Recess
19 Axial securing
20 Bolt
21 Opening
22 Slanted surface
23 Transition
24 Flank
25 Recess
26 Plate
27 Borehole
A1 Spacing of 9, 10
A2 Spacing of y-z axis
A3 Spacing of contact surface from 10
A4 Parallel spacing between 13/13
A5 Spacing of 14 from 9
D Axis of rotation
D1 Thickness of 11
D2 Thickness of 12
D4 Total thickness
W1 Angle
W2 Angle
W3 Angle

What is claimed is:

1. A blow bar configured for insertion in a blow bar holder of a rotor of an impact crusher, said blow bar defining a Cartesian coordinate system with a longitudinal axis, which runs in a z-direction, and configured to be rotationally symmetrical with respect to the longitudinal axis and to extend in axially parallel relationship to the blow bar holder when Inserted in the blow bar holder, a vertical axis which runs in a y-direction within the Cartesian coordinate system and is directed toward a radially outer top surface of the blow bar, and a transverse axis which runs in a x-direction within the Cartesian coordinate system and is directed toward a longitudinal side of the blow bar, said blow bar comprising:

upper and lower ends in vertically spaced-apart relationship; and two heads having each a rectangular cross section and being spaced apart to define there between a middle region in which the longitudinal axis centrally determines a position of a y-z plane, wherein one head is arranged at the upper end and another head is arranged at the lower end, each head having a front side surface and a rear side surface disposed on a long side and extending parallel to the y-z plane at a first spacing, so that the head has a thickness between the side surfaces, with the two heads situated offset to the y-z plane in an opposite direction by a second spacing in the transverse direction, thereby forming support shoulders in a transition to the middle region, said middle region having a thickness over a majority portion of its length, which thickness is not less than the first spacing between the front and rear side surfaces of the heads, and with a contact surface being situated between the middle region and the rear side surfaces of the two heads and raised in regard to the rear side surface, wherein the middle region has a slanted surface, said raised contact surface being adjoined by rounded flanks toward the rear side surface and toward the slanted surface, said flanks being entirely concavely rounded.

2. The blow bar of claim 1, wherein the thickness of the middle region is greater by at least 3% than the thickness of the heads.

3. The blow bar of claim 1, wherein each support shoulder defines with the rear side surface a flank angle that is less than 117°.

4. The blow bar of claim 1, wherein the support shoulders have each in the longitudinal direction a length which is longer than a length of the contact surface.

5. The blow bar of claim 1, wherein one of the side surfaces of each head defines a front side surface, with each support shoulder extending in the x-direction beyond the rear side surface and beyond the front side surface.

6. The blow bar of claim 1, wherein the middle region has front and rear slanted surfaces, each of which extending from the contact surface to the support shoulder, said front and rear slanted surfaces running not parallel to the y-z plane and wherein rounded transitions from the slanted surfaces to the support shoulders are situated in the x-z plane.

7. A blow bar configured for insertion in a blow bar holder of a rotor of an impact crusher, said blow bar defining a Cartesian coordinate system with a longitudinal axis, which runs in a z-direction, and configured to be rotationally symmetrical with respect to the longitudinal axis and to extend in axially parallel relationship to the blow bar holder when inserted in the blow bar holder, a vertical axis which runs in a y-direction within the Cartesian coordinate system and is directed toward a radially outer top surface of the blow bar, and a transverse axis which runs in a x-direction within the Cartesian coordinate system and is directed toward a longitudinal side of the blow bar, said blow bar comprising:

upper and lower ends in vertically spaced-apart relationship; and two heads having each a rectangular cross section and being spaced apart to define there between a middle region in which the longitudinal axis centrally determines a position of a y-z plane, wherein one head is arranged at the upper end and another head is arranged at the lower end, each head having a front side surface and a rear side surface disposed on a long side and extending parallel to the y-z plane at a first spacing, so that the head has a thickness between the side surfaces, with the two heads situated offset to the y-z plane in an opposite direction by a second spacing in the transverse direction, thereby forming support shoulders in a transition to the middle region, said middle region having a thickness over a majority portion of its length, which thickness is not less than the first spacing between the front and rear side surfaces of the heads, with each support shoulder extending in the x-direction beyond the rear side surface and beyond the front side surface, and with a contact surface being situated between the middle region and the rear side surfaces of the two heads and raised in regard to the rear side surface, wherein the support shoulders form flanks of longitudinal webs, with the longitudinal webs being raised in regard to the front side surfaces and being trapezoidal in cross section.

8. The blow bar of claim 7, wherein the thickness of the middle region is greater by at least 3% than the thickness of the heads.

9. The blow bar of claim 7, wherein each support shoulder defines with the rear side surface a flank angle that is less than 117°.

10. The blow bar of claim 7, wherein the support shoulders have each in the longitudinal direction a length which is longer than a length of the contact surface.

11. The blow bar of claim 7, wherein the longitudinal webs have a width which is broader in the y-direction than a width of the contact surface.

12. The blow bar of claim 7, wherein the middle region has front and rear slanted surfaces, each of which extending from the contact surface to the support shoulder, said front and rear slanted surfaces running not parallel to the y-z plane.

13. The blow bar of claim 12, wherein rounded transitions from the front and rear slanted surfaces to the support shoulders are situated in the x-z plane.

14. The blow bar of claim 7, wherein the front side surface has a recess to hold an axial securing, said recess situated opposite the contact surface, so that the thickness of the middle region in an area of the recess is not less than the thickness of the heads.

15. A blow bar configured for insertion in a blow bar holder of a rotor of an impact crusher, said blow bar defining a Cartesian coordinate system with a longitudinal axis, which runs in a z-direction, and configured to be rotationally symmetrical with respect to the longitudinal axis and to extend in axially parallel relationship to the blow bar holder when inserted in the blow bar holder, a vertical axis which runs in a y-direction within the Cartesian coordinate system and is directed toward a radially outer top surface of the blow bar, and a transverse axis which runs in a x-direction within the Cartesian coordinate system and is directed toward a longitudinal side of the blow bar, said blow bar comprising:

upper and lower ends in vertically spaced-apart relationship; and two heads having each a rectangular cross section and being spaced apart to define there between a middle region in which the longitudinal axis centrally determines a position of a y-z plane, wherein one head is arranged at the upper end and another head is arranged at the lower end, each head having a front side surface and a rear side surface disposed on a long side and extending parallel to the y-z plane at a first spacing, so that the head has a thickness between the side surfaces, with the two heads situated offset to the y-z plane in an opposite direction by a second spacing in the transverse direction, thereby forming support shoulders in a transition to the middle region, said middle region having a thickness over a majority portion of its length, which thickness is not less than the first spacing between the front and rear side surfaces of the heads, with each support shoulder extending in the x-direction beyond the rear side surface and beyond the front side surface, and with a contact surface being situated between the middle region and the rear side surfaces of the two heads and raised in regard to the rear side surface, wherein the front side surface has a recess to hold an axial securing, said recess situated opposite the contact surface, so that the thickness of the middle region in an area of the recess is not less than the thickness of the heads.

16. An impact crusher, comprising:

a rotor defining an axis of rotation, a blow bar holder mounted on the rotor and having a recess oriented parallel to the axis of rotation, and a blow bar according to claim 1, installed in the recess of the blow bar holder.

17. An impact crusher, comprising:

a rotor defining an axis of rotation, a blow bar holder mounted on the rotor and having a recess oriented parallel to the axis of rotation, and a blow bar according to claim 7, installed in the recess of the blow bar holder.

* * * * *